US005225061A

United States Patent [19]

Westerlund

[11] Patent Number: 5,225,061

[45] Date of Patent: Jul. 6, 1993

[54] BIPOLAR ELECTRODE MODULE

[76] Inventor: Goethe O. Westerlund, 5041 Cypress Street, Vancouver, British Columbia, Canada, V6M 3P9

[21] Appl. No.: 705,100

[22] Filed: May 24, 1991

[51] Int. Cl.[5] ..... C25B 9/00

[52] U.S. Cl. ..... 204/254; 204/255; 204/256; 204/268; 204/288; 204/289; 204/292; 204/293

[58] Field of Search ..... 204/254, 255, 256, 268, 204/292, 293, 288, 289

[56] References Cited

U.S. PATENT DOCUMENTS

| | | | |
|---|---|---|---|
| 3,410,784 | 11/1968 | Maunsell et al. | 204/268 |
| 3,468,787 | 9/1969 | Westerlund | 204/268 |
| 3,497,433 | 2/1970 | Weed | 204/95 |
| 3,859,197 | 1/1975 | Bouy et al. | 204/284 |
| 3,994,798 | 11/1976 | Westerlund | 204/268 |
| 4,069,130 | 1/1978 | Riggs, Jr. | 204/268 |
| 4,089,771 | 5/1978 | Westerlund | 204/284 |
| 4,098,671 | 7/1978 | Westerlund | 204/284 |
| 4,116,807 | 9/1978 | Peters | 204/290 |
| 4,338,179 | 7/1982 | Dickson et al. | 204/284 |
| 4,339,323 | 7/1982 | Dilmore et al. | 204/256 |
| 4,402,809 | 9/1983 | Dilmore et al. | 204/254 |
| 4,414,088 | 11/1983 | Ford | 204/237 |
| 4,461,692 | 7/1984 | Raetzsch, Jr. | 204/268 |
| 4,529,494 | 7/1985 | Joó et al. | 204/290 |
| 4,564,433 | 1/1986 | Werdecker et al. | 204/254 |

FOREIGN PATENT DOCUMENTS

| | | | |
|---|---|---|---|
| 938358 | 12/1973 | Canada | 337/43 |
| 945743 | 4/1974 | Canada | 26/25 |
| 966281 | 4/1975 | Canada | 26/25 |
| 986456 | 3/1976 | Canada | 204/191 |
| 990681 | 6/1976 | Canada | 204/191 |
| 1032892 | 6/1978 | Canada | 204/191 |
| 1036540 | 8/1978 | Canada . | |
| 1053177 | 4/1979 | Canada | 204/155 |
| 1084444 | 8/1980 | Canada | 204/184 |
| 1094981 | 2/1981 | Canada | 204/196 |
| 1128002 | 7/1982 | Canada | 204/191 |
| 1143334 | 3/1983 | Canada | 204/184 |
| 1143335 | 3/1983 | Canada | 204/184 |
| 1220165 | 4/1987 | Canada | 204/154 |
| 1230081 | 12/1987 | Canada | 204/191 |
| 0107135 | 10/1983 | European Pat. Off. . | |
| 0094772 | 11/1983 | European Pat. Off. . | |
| 81009680 | 11/1982 | Sweden . | |

*Primary Examiner*—John Niebling
*Assistant Examiner*—Arun S. Phasge
*Attorney, Agent, or Firm*—Louis Weinstein

[57] ABSTRACT

A novel bipolar electrode module is provided. Such module includes a generally-rectangular, plate-like metallic cathode, a generally-rectangular, plate-like metallic anode, the plate-like metallic cathode and anode being disposed in edge-to-edge butting relationship, thereby to align the plate-like metallic cathode to lie in the same plane as the plate-like metallic anode; and the butting relationship between the plate-like metallic anode and the plate-like metallic cathode being provided by a coextensive joint between the respective abutting edges of the plate-like metallic anode and the plate-like metallic cathode, the joint comprising a mechanical integration fit between a plurality a plurality of male tongues on an edge of one metallic plate and a similar plurality of female grooves in an edge of the other metallic plate. The joint provides: structural rigidity for the module; and electrically-conducting zone of low resistance; and no increase in module thickness. The module of such construction provides assemblies of electrolytic cells of improved operating load factors, compactness and sustained reduced electrical power consumption.

19 Claims, 3 Drawing Sheets

BIPOLAR ELECTRODE MODULE

BACKGROUND OF THE INVENTION (i) Field of the Invention

This invention relates to bipolar electrodes. it also relates to modular bipolar electrode assemblies which are especially adapted for use in a bipolar electrolytic cell of the type used for the manufacture of chlorates, perchlorates, persulphates, or hydroxides and to the bipolar electrolytic cell so provided.

(ii) Description of the Prior Art

Bipolar electrolytic cells have been mainly successful, but improvements have been desired for the bipolar electrodes per se.

There are many forms of bipolar electrodes which are essential elements of a bipolar electrolytic cell. For example, U.S. Pat. No. 4,089,771 issued May 16, 1978 to H. B. Westerlund, provided a bipolar electrode including a cathodic element, the exposed outer surface of which was of an activated porous titanium nature. The central core of the cathodic element was formed of a titanium sheet, which extended outwardly from an edge of the cathode to provide the anode.

U.S. Pat. No. 4,116,807 patented Sep. 26, 1978 by E. J. Peters, provided a face-to-face bipolar electrode which included explosion bonded solid metallic strips between the two blackplates of a bipolar electrode to provide the essential electrical and mechanical connection therebetween.

U.S. Pat. No. 4,414,088 issued Nov. 8, 1983 to J. B. Ford, provided a bipolar electrode including anodic and cathodic metal layers intimately and integrally connected by explosive binding, to opposite faces of an electrically-conducting metal layer.

Other patents provided bipolar electrodes which included a central conductor to which parallel, spaced-apart anodes and cathodes were electrically connected on opposite sides thereof. In these prior patents, assembly was required whereby the anode was to be facing the cathode and viceversa. Great care was necessary in assembling such bipolar electrodes to avoid causing electrical short circuits.

In another type of bipolar electrode, the anode and cathode parts were each made from the same material. The anode part had and electrocatalytic active coating, or both parts consisted of alloys having the same main components.

U.S. Pat. No. 4,098,671 patented on Jul. 4, 1978 by H. B. Westerlund, provided several embodiments of bipolar electrodes. In one embodiment, the cathode was connected to the anode in an edge-to-edge orientation by means of an upstanding, "U"-shaped (in cross-section) median electrode. The connection was by means of welding.

Canadian Patent No. 990,681 patented Jun. 8, 1976 by Pierre Bouy et al, provided a bipolar electrode having an anodically active part comprising a film-forming metal covered with a conducting layer which was inert to electrolytes, and a cathodically-active part comprising a metal which could be used cathodically. The anodically and cathodically active parts were separated in space and were connected together by an electrical connection. The two electrolytically-active parts were apertured, the electrical connection between them being made through the contact formed within a plurality of bonded members produced by plating a metal which can be used cathodically with a film-forming metal. The bonded members were part of a sealing partition separating the two electrolytically active parts.

Canadian Patent No. 1,032,892 patented Jun. 13, 1978 by H. B. Westerlund, provided an improvement in such electrode by providing electrically-insulating spacer elements projecting from both side faces of the cathode.

Canadian Patent No. 1,053,177 patented Apr. 24, 1979 by Maomi Seko, et al, provided a bipolar electrolytic cell including a partition wall made of explosion-bonded titanium plate and iron plate which partitioned the cell into an anode chamber and a cathode chamber. The anode was formed of a titanium substrate having platinum group metal oxides coated thereon, which was connected electrically to the titanium of the partition wall in a manner such that space was provided between the anode and the titanium of the partition wall. The cathode was formed of iron which was connected electrically to the iron of the partition wall in a manner such that space was provided between the cathode and the iron of the partition wall.

Canadian Patent No. 1,094,981 patented Jan. 3, 1981 by James D. McGilvery, provided a bipolar electrode including a layer of a passivatable metal, typically titanium, having a conductive anolyte-resistant anode surface, a layer of iron or an alloy thereof, typically steel, providing the cathode, and a layer of a metal or alloy thereof resistant to atomic hydrogen flow positioned between, and in electrical contact with, the iron or alloy thereof and the passivatable metal layer.

Canadian Patent No. 1,128,002 patented Jul. 20, 1982 by Ronald Dickson, et al, provided an electrode for use in a diaphragm or membrane cell having a gap of a given width between adjacent diaphragms or membranes. The electrode included two electrode sheets disposed substantially parallel to each other, and an elongate current feeder post located between, and directly attached to, the sheets along their centre line. The sheets were thus resiliently movable towards one another for insertion into the gap and springable outwardly when in the gap. The two electrode sheets included a web portion and on each side of the web portion were integral, substantially planar portions having an anodically active outer layer on at least part of their surfaces. The two web portions were directly attached to opposite sides of the current feeder post and included two flanges which were splayed outwardly from the current feeder post so that the two free edges of the planar portions of the electrodes were spaced wider apart than the parts of planar portions closest to the connection line with the flange. The free edges were spaced further apart than the width of the gap between the diaphragms or membranes. The electrode working sheets could be imperforate or foraminous.

Canadian Patent no. 1,143,334 patented Mar. 22, 1983 by Kin Seto, et al, provided a bipolar electrode assembly including first and second base plates disposed in parallel relationship at a distance from each other, a number of spaced-apart pairs of perforated metal electrode plates projecting from the first base plate at essentially right angle thereto in the direction of but short of the distance to the second base plate, and an equal number of metal electrode plates projecting from the second base plate in the direction of but short of the distance to the first base plate. Each one of the metal electrode plates which projected from the second base plate projected, and was sandwiched between, the two members of a corresponding pair of perforated metal electrode plates and has its opposite faces insulated from the individual members by a thin film of an electrically-insulating material carrying perforations similar and aligned with those of the perforated electrodes.

Canadian patent No. 1,143,335 patented Mar. 22, 1983 by Kine Seto, et al, provided a bipolar electrode assembly including first and second base plate disposed in parallel relationship at a distance from each other, at least one row of equidistantly spaced-apart finger-like metal cathodes projecting from the first base plate in the direction of, but short of the distance to the second base plate. The cathodes in each row were in a same plane essentially perpendicular to the base plates. For each row of finger-like metal cathodes, a corresponding co-planar row of finger-like metal anodes projected from the second base plate in the direction of, but short of, the distance to the first base plate. The anodes and cathodes of corresponding coplanar rows of anodes and the cathodes were interdigitated and were insulated from each other by a thin layer of a non-electrically conductive insulating material.

Swedish Patent No. 8100968 of Kemanord AB., provided a compound electrode for electrolysis, which includes several parts which were connected to each other mechanically in such a away that a high and even pressure was applied. The electrode construction included five parallel connected parts. Each part comprised a U-shaped component, and a T-shaped component. These components were shrink-welded together. The U-shaped parts were then connected to a plate.

The art has also provided bipolar electrodes which were coextensive plate-like in nature and which were connected edge-to-edge. One such bipolar electrode was described in Canadian Patent NO. 1,036,540 patented Aug. 15, 1978 by C. N. Raetzsch, Jr., et al. In that patent, the bipolar electrode included a plurality of sets, each set comprising a pair of spaced-apart cathode plates and a pair of spaced-apart anode plates. The pair of cathode plates were interconnected at one end at their edges by a conductor, and the pair of anode plates were likewise connected at one end at their edges by a conductor. These two conductors were interconnected by a conducting means. Such conducting means included an interposed metal member of less height than the height of the anode and cathode plates, and upper and lower insulating members. The other open end of the pair of anode plates was secured within two arms of an "H" profile insulating member, and the other arm of the "H" profile secured the open ends of a pair of cathode plates. Thus, the bipolar set includes the sequence: an anode; an insulator; a cathode; a conductor; an anode; an insulator; a cathode; and a conductor.

Another such bipolar electrode was described in canadian Patent No. 1,220,165 patented Apr. 7, 1987 by C. N. Raetzsch, Jr. In that patent a bipolar electrode was provided which was a single, unitary blade having an anodic portion and a cathodic portion, formed of titanium, or a titanium/yttrium alloy, with the cathode portion, which faced an anode portion, being perforated.

Still another such bipolar electrode was disclosed in Canadian Patent No. 1,230,081 patented Dec. 8, 1987 by P. Fabian, et al. In that patent, a bipolar electrode was provided having a flat plate-like shape, including an anode part made of a first material, a cathode part made of a second material, and a generally integral, pre-prefabricated intermediate piece having the shape of a strip whose thickness generally corresponded to the thickness of the anode part and of the cathode part. The strip was so positioned that its surfaces were generally co-planar with those of the anode and cathode parts, while side edge portions of the strip abutted against the respective one of the anode and cathode parts. the intermediate piece was comprised of a first side section and of a second side section, the side sections adjoining each other along an abutment joint extending longitudinally of the intermediate piece. The first section was made of a material having generally the same composition as the material, and the second section was made of a material having generally the same composition as the second material. A first abutment weld was provided between the first side section and the anode part, and a second abutment weld was provided between the first side section and the cathode part. Thus, a generally integral bipolar plate-like electrode was formed having the anode part and the cathode part made of different materials.

In all the above patented bipolar electrodes, problems still arose. A welded joint had problems due to the dissimilar metal properties. Explosion bonding developed interface problems, of which hydriding was the most typical. A lapped joint had several disadvantages, namely: the extra material cost due to the overlay; the increased thickness of the module; and problems with securing the joint without suffering dimensional instability. A bipolar electrode having a U-shaped profile which spaced the electrodes and blocked current leakage between the cells, nevertheless also lengthened the path of the current. Such lengthening of the current path required an increase in the voltage, which increased the cost of production.

SUMMARY OF THE INVENTION (i) Aims of the invention

Accordingly the present invention aims to provide an electrode plate module which is bipolar, and in which the joint between the anode and the cathode plates of the module is of a novel construction.

Another object of this invention is to provide the means for providing such joint, and for unitizing the two plates to comprise the bipolar electrode.

Still another object of this invention is to provide a joint with the means for achieving low electrical resistance.

Still another object of this invention is to provide a joint of improved structural rigidity.

Still another object of this invention is to provide a electrode module where thickness is determined by the thickness of the anode or cathode plates and not by means of an overlap at the joint.

Yet another object of this invention is to provide a bipolar electrode which has improved structural strength and rigidity, allowing employing either thin or thick electrode plates, and of dimensions best serving the economics of the capital cost of the electrolyzer and the product manufacturing cost.

Still another object of this invention is to provide a bipolar electrode which employs titanium as the base metal and which, when used in an electrolysis cell as a cathode, provides acceptable current conductance performance, less overvoltage (or at least equal to ) than conventional cathodes, dimensional stability over years of operating with little corrosion and minimizes the corrosive action at the joint to current connector means.

Another object of this invention is to provide an electrode assembly which is adaptable to most conventional electrolyzers employing the bipolar electrode principle with electrical current flow from one cell to an adjacent cell in a multi-cell electrolyzer.

(ii) Statements of Invention

According to this invention, a bipolar electrode is provided comprising: a generally-rectangular, plate-like metallic anode; a generally-rectangular, plate-like metallic cathode, the plate-like metallic cathode and anode being disposed in edge-to-edge butting relationship, thereby to align the plate-like metallic cathode to lie in the same plane as the plate-like metallic anode; and the butting relationship between the plate-like metallic anode and the plate-like metallic cathode being provided by a coextensive joint between the respective abutting edges of the plate-like metallic anode and the plate-like metallic cathode, the joint comprising a mechanical integration fit between a plurality of male tongues on an edge of one metallic plate and a similar plurality of female grooves in an edge of the other metallic plate.

This invention also provides a bipolar electrode module comprising: a generally-rectangular, plate-like metallic anode; a generally-rectangular, plate-like metallic cathode, the plate-like metallic cathode and anode being disposed in edge-to-edge butting relationship thereby to align the plate-like metallic cathode to lie in the same plane as the plate-like metallic anode; and butting relationship between the plate-like metallic anode and the plate-like metallic cathode being provided by a coextensive joint between the respective abutting edges of the plate-like metallic anode and the plate-like metallic cathode, the joint comprising a mechanical integration fit between a plurality of male tongues on an edge of one metallic plate and a similar plurality of female grooves in an edge of the other metallic plate; and around the joint, an electrically non-conductive material disposed between the anode plate and the cathode plate for lowering electrical current leakage.

The invention further provides a modular bipolar electrode assembly comprising: a plurality of bipolar electrode modules, each such module comprising a generally-rectangular, plate-like metallic anode; a generally-rectangular, plate-like metallic cathode, the plate-like metallic cathode and anode being disposed in edge-to-edge butting relationship, thereby to align the plate-like metallic cathode to lie in the same plane as the plate-like metallic anode; and the butting relationship between the plate-like metallic anode and the plate-like metallic cathode being provided by a coextensive joint between the respective abutting edges of the plate-like metallic anode and the plate-like metallic cathode, the joint comprising a mechanical integration fit between a plurality of male tongues on an edge of one metallic plate and a similar plurality of female grooves in an edge of the other metallic plate wherein the anode plates are interleaved with, and face respective cathode plates; and including anodic end connectors connected to the anode plates; cathodic end connectors connected to the cathode plates; an anode bus bar connected to the anodic end connectors; and a cathode bus bar connected to the cathodic end connectors.

The invention still further provides a modular bipolar electrode assembly, the assembly comprising: a plurality of bipolar electrode modules, each such module comprising a generally-rectangular, plate-like metallic anode; a generally-rectangular, plate-like metallic cathode, the plate-like metallic cathode and anode being disposed in edge-to-edge butting relationship, thereby to align the plate-like metallic cathode to lie in the same plane as the plate-like metallic anode; and the butting relationship between the plate-like metallic anode and the plate-like metallic cathode being provided by a coextensive joint between the respective abutting edges of the plate-like metallic anode and the plate-like metallic cathode, the joint comprising a mechanical integration fit between a plurality of male tongues on an edge of one metallic plate and a similar plurality of female grooves in an edge of the other metallic plate; and around the joint, an electrically non-conductive material disposed between the anode plate and the cathode plate for lowering electrical current leakage; wherein the anode plates are interleaved with, and face respective cathode plates, and including anodic end connectors connected to the anode plates; cathodic end connectors connected to the cathode plates; an anode bus bar connected to the anodic end connectors; and a cathode bus bar connected to the cathodic end connectors.

In addition, this invention provides a closed loop system for effecting an electrolysis reaction and for subsequently removing reacted products of electrolysis, including a multicell electrolzyer including inlet means for fresh electrolyte thereto, and outlet means for electrolyte-soluble ion and gaseous products of electrolysis therefrom, inlet means for recycled electrolyte and electrolyte soluble ion products for electrolysis thereto and outlet means for electrolyte soluble ion products of electrolysis therefrom; and a plurality of interconnected electrolytic cells, each such cell being provided with bipolar metal electrodes disposed in the path of the electrolyte flow between the fresh electrolyte inlet means and the electrolyte soluble ion and gaseous electrolysis products outlet means, each bipolar metal electrode comprising: a generally-rectangular, plate-like metallic anode; a generally-rectangular, plate-like metallic cathode, the plate-like metallic cathode and anode being disposed in edge-to-edge butting relationship, thereby to align the plate-like metallic cathode to lie in the same plane as the plate-like metallic anode; and the butting relationship between the plate-like metallic anode and the plate-like metallic cathode being provided by a coextensive joint between the respective abutting edges of the plate-like metallic anode and the plate-like metallic cathode, the joint comprising a mechanical integration fit between a plurality of male tongues on an edge of one metallic plate and a similar plurality of female grooves in an edge of the other metallic plate; the electrolytic cells further including one end wall providing an anodic terminal connection, with an anode bus bar connected to the anode terminal connection; and the other end wall providing a cathodic terminal connection, with a cathodic bus bar connected to the cathodic terminal connection.

Furthermore, this invention provides a closed loop system for effecting an electrolysis reaction and for subsequently removing reacted products of electrolysis, including a multicell electrolyzer comprising inlet means for fresh electrolyte thereto, and outlet means for electrolyte soluble ion and gaseous products of electrolysis therefrom, inlet means for recycled electrolyte and electrolyte soluble ion products of electrolysis thereto and outlet means for electrolyte soluble ion products of electrolysis therefrom; and a plurality of interconnected electrolyte cells, each provided with bipolar metal electrodes disposed in the path of the electrolyte flow between the fresh electrolyte inlet means and the electrolyte-soluble ion and gaseous electrolysis products outlet means, each bipolar metal electrode comprising: a generally-rectangular plate-like metallic anode; a generally-rectangular, plate-like metallic cathode, the plate-like metallic cathode and anode being disposed in edge-to-edge butting relationship, thereby to align the plate-like metallic cathode to lie in the same plane as the plate-like metallic anode; and the butting relationship between the plate-like metallic anode and the plate-like metallic cathode being provided by a coextensive joint between the respective abutting edges of the plate-like metallic anode and the plate-like metallic cathode, the joint comprising a mechanical integration fit between a plurality of male tongues on an edge of one metallic plate and a similar plurality of female grooves in an edge of the other metallic plate, and around the joint, an electrically non-conductive material disposed between the anode plate and the cathode plate for lowering electrical current leakage; the electrolytic cells further including one end wall providing an anodic terminal connection, with an anode bus bar connected to the anode terminal connection, and the other end wall providing a cathodic terminal connection, with a cathodic bus bar connected to the cathodic terminal connection.

OTHER FEATURES OF THE INVENTION

In the bipolar electrode module, the male tongues each preferably comprise a fin projecting from its associated edge, and twisted 90°, and preferably each female groove is a slot extending inwardly from its associated edge, the thickness of the tongues being substantially-equal to the width of the slots. The thickness of the anode plate and cathode plate are preferably different, and the width of each fin is then preferably equal to the thickness of the adjacent plate. The node preferably is the thinner plate, and is provided with the plurality of twisted fins.

The mechanical integration fit is preferably provided by fins of one plate being compressed into slots of the other plate, the compression providing a physical contact pressure between contact surfaces by swelling of the fins during the action of compressing. The content surfaces are preferably on both sides of the fins.

The anode plate preferably is an anode comprising a valve metal selected from the group consisting of titanium, tantalum, zirconium, niobium, hafnium, tungsten or tantalum or an alloy of one or more of these metals. The valve metal may optionally have an anodic coating thereon comprising a platinum group metal selected from the group consisting of platinum, palladium, iridium, ruthenium, osmium or rhodium and alloys thereof, and mixtures thereof, or a platinum group metal oxide selected from the group consisting of oxides of ruthenium, rhodium, palladium, osmium, iridium, and platinum.

The cathode plate preferably is a cathode selected from an electrically-conductive substance which is resistant to the catholyte, selected from the group consisting of steel, stainless steel, nickel, iron, ferrochromium or alloys of the above metals, or iron alloys containing nickel, chromium, molybdenum, or carbon, the cathode optionally having a plating thereon of nickel, or a nickel alloy or a nickel compound.

Most preferably, the anode is titanium coated with a platinum group metal and the cathode is stainless steel.

Titanium is resistant to wear when used as an anode in electrolytic cells of the chlorate, perchlorate or chlorine/alkali type. Thus titanium substantially eliminates maintenance requirements, production disruptions, impurities in the electrolyte (suspended as well as dissolved) and does not require capital investment and operating cost of cathodic protection equipment.

The fins may be surface coated to prevent oxidizing of the substrate material. If the fins are coated, the surface coating may be an anodic coating thereon as previously described, namely of a platinum group metal selected from the group consisting of platinum, palladium, iridium, ruthenium, osmium or rhodium and alloys thereof, or of a platinum group metal oxide selected from the group consisting of oxides of ruthenium, rhodium, palladium, osmium, iridium, and platinum.

In the second embodiment of the bipolar electrode, the electrically non-conductive material may comprise a material selected from the group consisting of polyvinyl chloride, heat-resistant polyvinyl chloride, polyethylene, polypropylene, silicone rubber, polytetrafluoroethylene, polychlorotrifluoroethylene, polyvinylidene fluoride, polyvinyl dichloride (PVDC), KYNAR TM, or KEL-F TM. Such material may be in sheet form, which may be folded and interwoven with the tongues and grooves to extend along the side faces of one metal electrode; or it may be in the form of a solid profile embracing a side edge and two adjacent side faces of one such bipolar metal electrode.

GENERALIZED DESCRIPTION OF THE INVENTION

In the electrode of this invention, the anode is one part of the electrode and the cathode is an integral part of the same electrode. Accordingly, the "connection" between such parts provides low electrical resistance, no significant deterioration with time, and structural strength for handling and use.

As is well known, anode materials for bipolar electrodes usually use valve metals. Valve metals are metals which form non-conductive oxides which are resistant to the anolyte. Valve metals are used, conventionally, because they are dimensionally stable. Typical such anode materials are titanium, tantalum, zirconium, niobium, hafnium, tungsten or tantalum or an alloy of one or more of these metals. The foundation body of the anode material may also include an electrically conductive surface, for example, of a platinum metal, or a platinum metal oxide, or a conductive metal oxide or oxide mixture resistant to the anolyte. In any event, the anode should be formed with, or have a coating of, an anodically-active material, i.e., a material capable of operating as an anode, and capable of passing an electrical current without passivating and without rapidly dissolving.

The material for the cathode in such bipolar electrodes was selected from an electrically-conductive substance which is resistant to the catholyte; this is usually steel, stainless steel, nickel, iron, or alloys of the above metals, or iron alloys containing nickel, chromium, molybdenum or carbon. The cathode, like the anode, is preferably made from flat sheet or plates.

If titanium is used as a cathode, it may form a hydride and consequently some corrosion could occur should the electrolyte temperature be excessive (i.e., above about 100° C.) and equalization of electrical potential in the cell under such circumstances would be poor.

BRIEF DESCRIPTION OF THE DRAWINGS

In the accompanying drawings.

DESCRIPTION OF PREFERRED EMBODIMENTS

Figure 1:
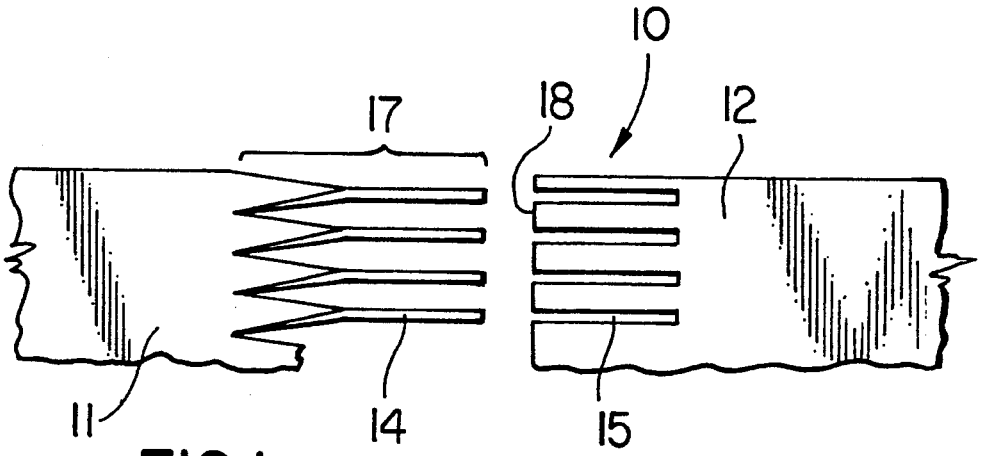
FIG. 1 is a side elevational view of the bipolar electrode prior to its press-fit assembly.
Figure 2:
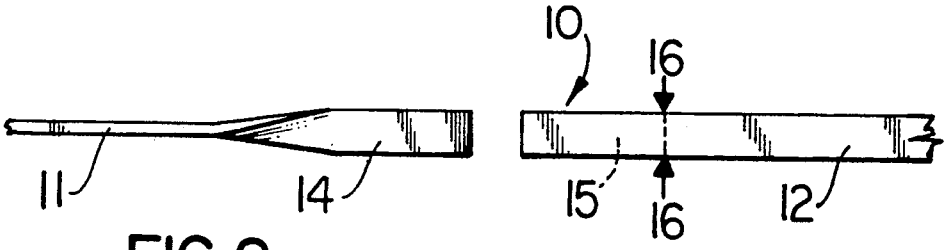
FIG. 2 is a top view of the bipolar electrode prior to its press-fit assembly.
Figure 3:
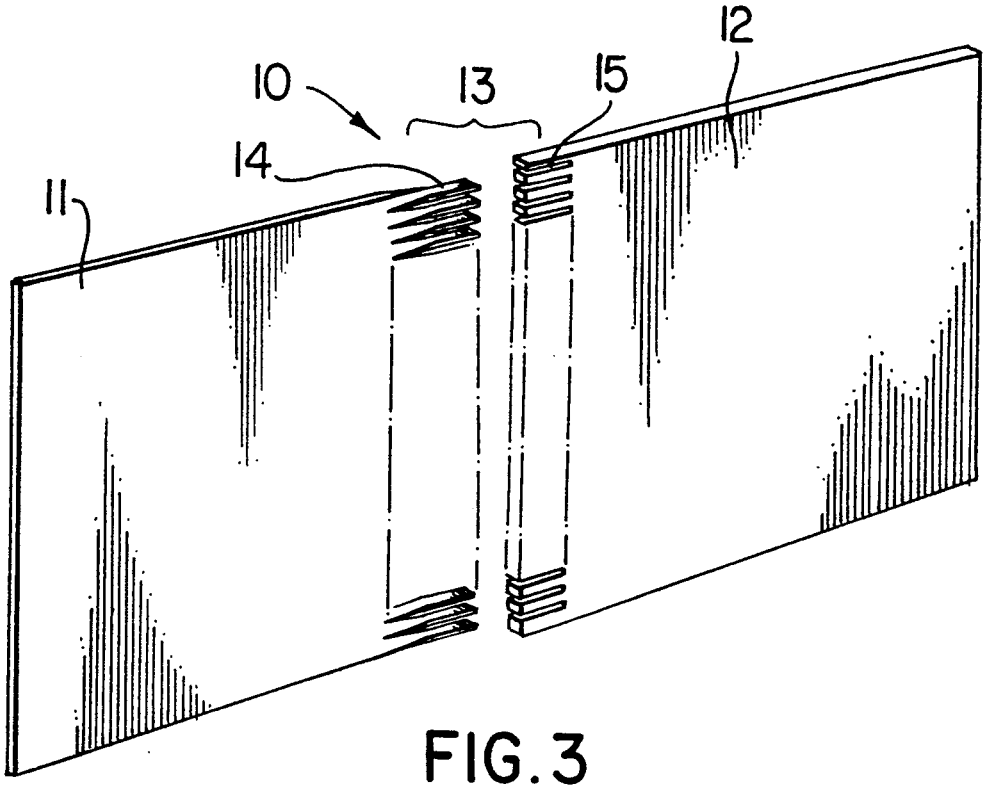
FIG. 3 is a perspective view of a modular electrode of one embodiment of this invention, with a portion thereof shown in exploded from to indicate the assembly thereof.

As seen in FIGS. 1-3 of the drawings, the module 10 comprises a metallic generally plate-like anode 11, a metallic generally plate-like cathode 12, separated by, and connected together by means of, a coextensive joint 13, thus unitizing the electrodes 11, 12 as one element or module 10. In order to achieve this assembly, anode 11 is provided with fins 14 which are insertable into mating slots 15 which are preformed in the cathode plate 12. The mechanical joint 13 comprises a press fit.

In one preferred manufacturing technique the anode 11 is sheared at one end to provide protruding fins 14, preferably having a width somewhat larger than the thickness 16 of cathode 12. The length 17 of the shear into the anode plate 11 end is determined by minimum length requirement to facilitate a 90° twisted fin 14 and the desired length of the mechanical joint 13. A longer fin represents larger surface contact at the joint and thus provides less electrical resistance at the interface.

The cathode plate 12 is provided with a plurality of slots 15 which are machined into the lateral edge 10 thereof. These slots may be machined, saw cut or laser cut, or otherwise provided. A preferred slot 15 is exactly centerlined to the fins 14 and has a thickness which is slightly wider than the thickness of the fins 14.

In fabrication of the module 10, as seen in FIG. 3, the two plates 11, 12 are positioned so that the overlapped fins 14 are adjacent the slots 15 to facilitate production of joint 13. Joint 13 is machine pressed thereby compacting the fins to the same width as plate 12.

Figure 4:
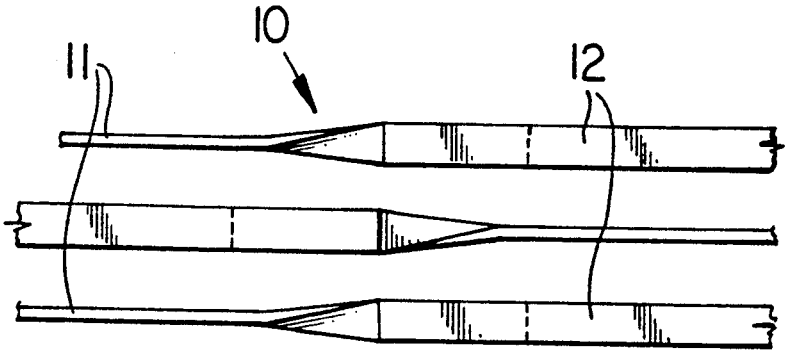
FIG. 4 is a top plan view of three of a plurality of interleaved bipolar electrode modules.
Figure 5:
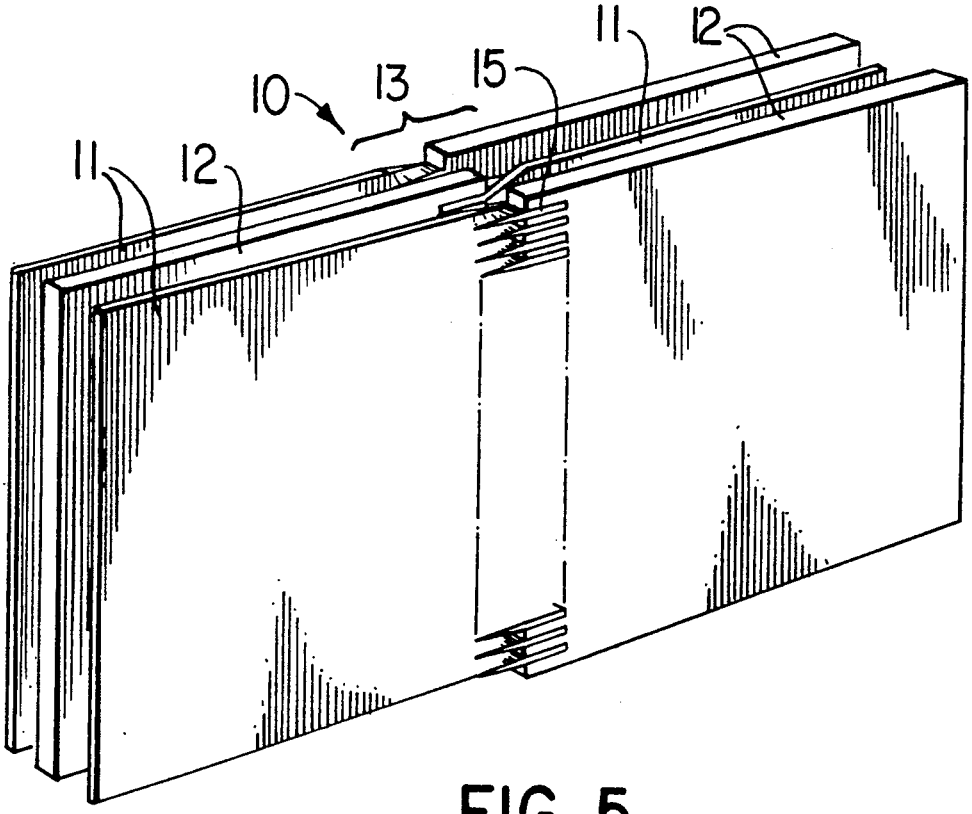
FIG. 5 is a perspective view of three of a plurality of interleaved bipolar electrode modules.

Description of FIGS. 4 and 5

As seen in FIGS. 4 and 5 a plurality (e.g. three) of bipolar electrode modules 10 is provided with the anode 11 interleaved with, and facing, the cathode 12. Each anode is connected to an anodic end connector (not shown) while each cathode is connected to a cathodic end connector (not shown). The anodic end connectors are connected together by an anode bus bar (not shown) while the cathodic end connectors are connected together by a cathode bus bar (not shown).

Figure 6:
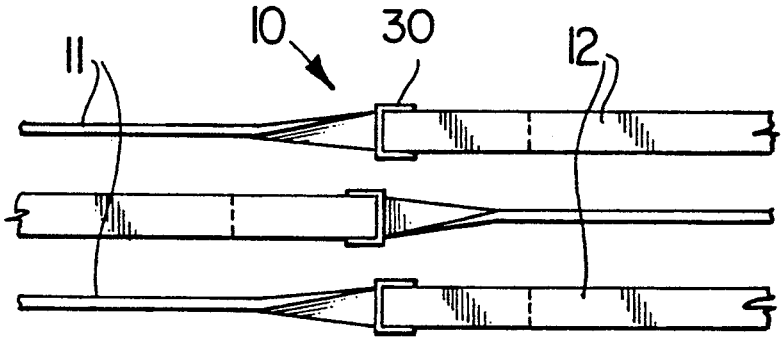
FIG. 6 is a top plan view three of a plurality of interleaved bipolar electrode modules of another embodiment of this invention which includes the current-leakage mode.
Figure 7:
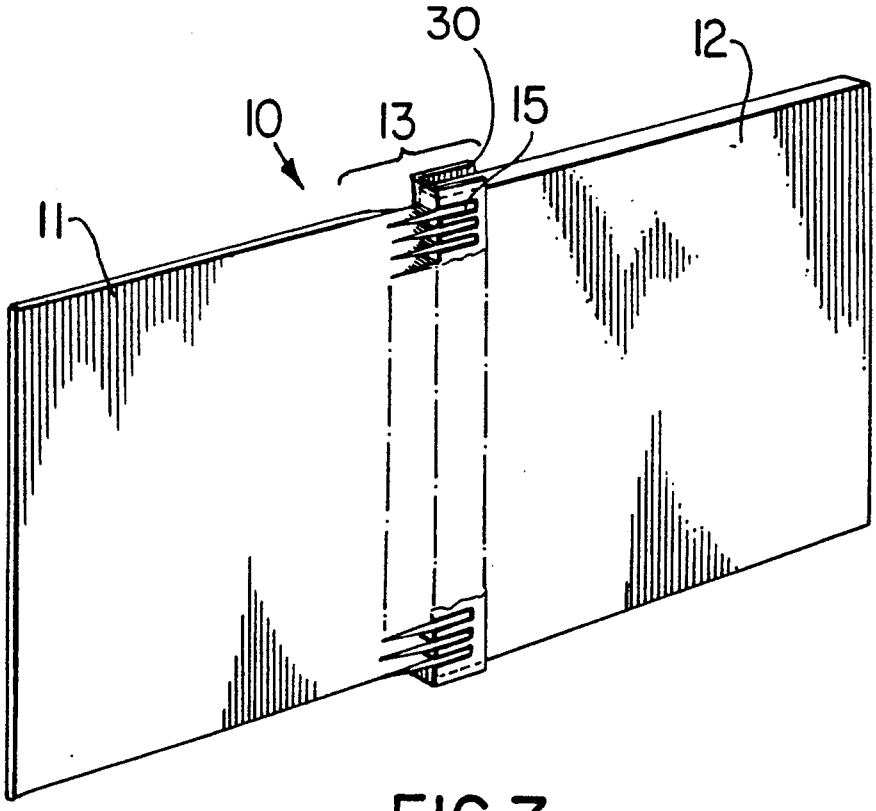
FIG. 7 is a perspective view of three of a plurality of interleaved bipolar electrode modules.

Description of FIGS. 6 and 7

As seen in FIGS. 6 and 7, an electrically non-conductive member 30 is disposed between the anode 11 and the cathode 12. This may be by means of a thin sheet of a suitable flexible electrically-non-conductive member as described above and placed on the fins 14 prior to the assembly of the fins 14 into the slots 15. In this way, a layer of the electrically non-conductive film is disposed between the fins 14 and the slots 15 and also along both side faces of the cathode 12.

Alternatively, the electrically non-conductive member may be an "H" profile having a plurality of vertically spaced-apart projections which are adapted to fit into the slots 15 and which can also encompass the fins 14. In this way a certain of the electrically non-conductive material is disposed between the fins 14 and the slots 15 and also along both side faces of the cathode 12.

EXAMPLES OF THE INVENTION

The following are comparative examples of the invention.

EXAMPLE

An electrolyzer of the type described in U.S. Pat. No. 4,101,406 issued Jul. 18, 1978 to G. O. Westerlund was assembled with electrode modules comprising electrode modules as described below:

anode plate: Titanium substrate with a noble metal, e.g. platinum surface coating. 300×300 mm size, 1.6 mm thickness. Length of fins before twisting, 10 mm; width, 3.3 mm with a total of 90 fins on the plate. Fins twisted 90°.

cathode plate: Mild steel, e.g. Sandvik 2205, Ferric steel, or 22% chromium steel, 300×300 mm size, 3.2 mm thickness, slots laser cut, 3.2 mm center line, 1.7 mm wide×7 mm long.

mechanical joint: 100 ton press.

The electrical resistance was 0.004 ohms per square mm. The resistance did not increase under a 18 months test period in salt, hypochlorite, dichromate and chlorate electrolyte. Concentration at times was up to 900 grams per liter as sodium chlorate. Current densities was up to 3,000 ampere per square meter and temperature up to 95° C.

The fins showed no deposit of hardness although the cathode had deposits.

By comparison, modules with a bolted joint comprising 3 mm bolts spaced 12 mm apart with 8 mm overlap showed 0.02 ohms per square mm initial electrical resistance, which increased to 5 ohms per square mm. The use of an alloyed steel cathode instead of an iron plate for the cathode showed 0.008 initial voltage and no change during the test period.

Still another test employing anodes which were surface coated with ruthenium oxide showed similar result and no increase in resistance over the 18 months test period.

Still another test was carried out in which a cell divider was carried by the joint in the manner shown in FIGS. 6 and 7. A TEFLON TM (polytetrafluoroethylene) sheeting strip, 0.4 mm thick was secured by the fins. The TEFLON strip was 13 mm wide and provided a curtain wall between adjacent modules of the same electrical potential. There was no apparent effect on performance of the joint, but the electrical current leakage was reduced to approximately 0.5% of total current applied.

Still another test employing sea water as electrolyte and temperatures as low as 12° C. showed no increase in electrical resistance over a two month test period.

Thus it is seen that the present invention provides a module with unitize anode and cathode plates by means of a mechanical compression joint which provides low electrical resistance, and structural rigidity as well as a means to support cell dividing curtains or profiles for separating modules when provided as an assembly in an electrolyzer.

The press contact of the fins in the slots lowers the electrical resistance and protect the surfaces from coatings and or hardness deposits. The surface contacts between the anode and cathode appears to provide direct transmission of electric current and does not act as electrodes at the joint.

The main objective which has been achieved is to integrate the dissimilar metal plates and achieve long term low electrical resistance at the joint.

The press/mechanical fit of the 90° twisted fins of the anode/cathode at the joint enables the anode to be provided in any desired thickness, since the width of the fins can be selected to be the same as the thickness of the cathode.

This provides great flexibility in the selection of the anode and cathode materials. This invention also provides an improvement over the teachings of the hereinbefore identified U.S. Pat. No. 3,994,798. The present invention provides protection against current leakage without lengthening the current path. This is provided by means of an inert electrically-insulating curtain, e.g. of TEFLON at the joint between the anode and the cathode.

The present invention also provides an improvement over U.S. Pat. No. 4,564,433. Explosion bonding of the anode to the cathode as taught by than patent permits the formation of titanium hydride which not only is a electrical circulating material, but also tends to split the joint.

Welding is unsuitable since titanium does not weld satisfactorily to other electrode materials.

CONCLUSION

From the foregoing description, one skilled in the art can easily ascertain the essential characteristics of this invention, and without departing from the spirit and scope thereof, can make various changes and modifications of the invention to adapt it to various usages and conditions. Consequently, all such changes and modifications are properly, equitably, and "intended" to be, within the full range of equivalence of the following claims.

I claim:

1. A bipolar electrode module comprising:

a generally-rectangular, plate-like metallic anode;

a generally-rectangular, plate-like metallic cathode, said plate-like metallic cathode and anode being disposed in edge-to-edge butting relationship, thereby to align said plate-like metallic cathode to lie in the same plane as said plate-like metallic anode; and said butting relationship between said plate-like metallic anode and said plate-like metallic cathode being provided by a coextensive joint between said respective abutting edges of said plate-like metallic anode and said plate-like metallic cathode, said joint comprising a mechanical integration fit between a plurality of male tongues on an edge of one metallic plate and a similar plurality of female grooves in an edge of the other metallic plate.

2. The bipolar electrode of claim 1 wherein: said male tongues each comprise a fin projecting from its associated edge, said fin being twisted 90° ; and wherein each female groove is a slot extending inwardly from its associated edge; the thickness of each said tongue being substantially-equal to the width of each said slot.

3. The bipolar electrode of claim 2 wherein: the thicknesses of the anode plate and the cathode plate are different; and wherein the width of each said fin is equal to the thickness of the adjacent cathode plate.

4. The bipolar electrode of claim 3 wherein: said anode is the thinner plate; and wherein said anode is provided with said plurality of twisted fins.

5. The bipolar electrode of claim 3 wherein: said mechanical integration fit is provided by said fins of one plate being compressed into associated said slots of said other plate; said compression thus providing a physical contact pressure between contact surfaces by swelling of said fins during the action of compressing.

6. The joint in claim 5 where said contact surface areas are on both sides of the fins.

7. The bipolar electrode of claim 1 wherein said anode is formed from a valve metal selected from the group consisting of titanium, tantalum, zirconium, niobium, hafnium, tungsten, tantalum and an alloy of one or more of said metals.

8. The bipolar electrode of claim 7 wherein said valve metal is provided with a coating thereon to act as an anode, said coating comprising a platinum group metal selected from the group consisting of platinum, palladium, iridium, ruthenium, osmium and rhodium and alloys thereof, and a platinum group metal oxide selected from the group consisting of oxides of ruthenium, rhodium, palladium, osmium, iridium, and platinum.

9. The bipolar electrode of claim 1 wherein said cathode is formed from an electrically-conductive substance which is resistant to the catholyte, and which is selected from the group consisting of alloys of iron with nickel, chromium, molybdenum and carbon.

10. The bipolar electrode of claim 9 wherein said cathode is provided with a plating thereon of nickel, or a nickel compound.

11. The bipolar electrode of claim 1 wherein said anode is formed of titanium coated with a platinum group metal; and wherein said cathode is formed of stainless steel.

12. A bipolar electrode module comprising:

a generally-rectangular, plate-like metallic anode;

a generally-rectangular, plate-like metallic cathode, said plate-like metallic cathode and anode being disposed in edge-to-edge butting relationship, thereby to align said plate-like metallic cathode to lie in the same plane as said plate-like metallic anode; and said butting relationship between said plate-like metallic anode and said plate-like metallic cathode being provided by a coextensive joint between said respective abutting edges of said plate-like metallic anode and said plate-like metallic cathode, said joint comprising a mechanical integration fit between a plurality of male tongues on an edge of one metallic plate and a similar plurality of female grooves in an edge of the other metallic plate; and around said joint, an electrically-non-conductive material disposed between said anode plate and said cathode plate for lowering electrical current leakage.

13. The bipolar electrode module of claim 12 wherein said electrically non-conductive material comprises a material selected from the group consisting of polyvinyl chloride, polyethylene, polypropylene, silicone rubber, polytetrafluoroethylene, polychlorotrifluoroethylene, polyvinylidene fluoride, and polyvinyl dichloride.

14. The bipolar electrode module of claim 12 wherein said electrically non-conductive material is in sheet form, and is adapted to extend along the side faces of one said metal anode or said metal cathode.

15. The bipolar electrode module of claim 12 wherein said electrically non-conductive material is a solid profile embracing a side edge and two adjacent side faces of one said metal anode or said metal cathode.

16. A modular bipolar electrode assembly comprising:

a plurality of bipolar electrodes modules, each said module comprising: a generally-rectangular, plate-like metallic anode; a generally-rectangular, plate-like metallic cathode, said plate-like metallic cathode and anode being disposed in edge-to-edge butting relationship, thereby to align said plate-like metallic cathode to lie in the same plane as said plate-like metallic anode; and said butting relationship between said plate-like like metallic anode and said plate-like metallic cathode being provided by a coextensive joint between said respective abutting edges of said plate-like metallic anode and said plate-like metallic cathode, said joint comprising a mechanical integration fit between a plurality of male tongues on an edge of one metallic plate and a similar plurality of female grooves in an edge of the other metallic plate;

around said joint, an electrically non-conductive material disposed between said anode plate and said cathode plate for lowering electrical current leakage;

said anode plates of said assembly being interleaved with, and facing respective cathode plates of said assembly;

anodic end connectors connected to said anode plates;

cathodic end connectors connected to said cathode plates;

an anode bus bar connected to said anodic end connectors; and a cathode bus bar connected to said cathodic end connectors.

17. A modular bipolar electrode assembly comprising:

a plurality of bipolar electrode modules, each said module comprising: a generally-rectangular, plate-like metallic anode; a generally-rectangular, plate-like metallic cathode, said plate-like metallic cathode and anode being disposed in edge-to-edge butting relationship, thereby to align said plate-like metallic cathode to lie in the same plane as said plate-like metallic anode; and said butting relationship between said plate-like metallic anode and said plate-like metallic cathode being provided by a coextensive joint between said respective abutting edges of said plate-like metallic anode and said plate-like metallic cathode, said joint comprising a mechanical integration fit between a plurality of male tongues on an edge of one metallic plate and a similar plurality of female grooves in an edge of the other metallic plate; and around said joint, an electrically-non-conductive material disposed between said anode plate and said cathode plate for lowering electrical current leakage;

said anode plates of said assembly being interleaved with, and facing respective cathode plates of said assembly;

anodic end connectors connected to said anode plates;

cathodic end connectors connected to said cathode plates;

an anode bus bar connected to said anodic end connectors; and a cathode bus bar connected to said cathodic end connectors.

18. A closed loop system for effecting an electrolysis reaction and for subsequently removing reacted products of electrolysis, including a multicell electrolyzer comprising inlet means for fresh electrolyte thereto, and outlet means for electrolyte soluble ion products and gaseous products of electrolysis therefrom, inlet means for recycled electrolyte and electrolyte-soluble ion products of electrolysis thereto, and outlet means for electrolyte-soluble ion products of electrolysis therefrom, said multicell electrolyzer including:

a plurality of interconnected electrolytic cells provided with bipolar metal electrodes disposed in the path of the electrolyte flow between the fresh electrolyte inlet means and the electrolyte-soluble ion and gaseous electrolysis products outlet means, each said bipolar metal electrode comprising: a generally-rectangular, plate-like metallic anode, a generally-rectangular, plate-like metallic cathode being disposed with said plate-like metallic anode in edge-to-edge butting relationship, thereby to align said plate-like metallic cathode to lie in the same plane as said plate-like metallic anode; and said butting relationship between said plate-like metallic anode and said plate-like metallic cathode being provided by a coextensive joint between said respective abutting edges of said plate-like metallic anode and said plate-like metallic cathode, said joint comprising a mechanical integration fit between a plurality of male tongues on an edge of one metallic plate and a similar plurality of female grooves in an edge of the other metallic plate;

around said joint, an electrically non-conductive material disposed between said anode plate and said cathode plate for lowering electrical current leakage; and one end wall providing an anodic terminal connection, with an anode bus bar connected to the anode terminal connection and other end wall providing a cathodic terminal connection, with a cathodic bus bar connected to the cathodic terminal connection.

19. A closed loop system for effecting an electrolysis reaction and for subsequently removing reacted products of electrolysis, including a multicell electrolyzer comprising inlet means for fresh electrolyte thereto, and outlet means for electrolyte-soluble ion products and gaseous products of electrolysis therefrom, inlet means for recycled electrolyte and electrolyte-soluble ion products of electrolysis thereto and outlet means for electrolyte soluble ion products of electrolysis therefrom, said multicell electrolyzer including:

a plurality of interconnected electrolytic cells provided with bipolar metal electrodes disposed in the path of the electrolyte flow between the fresh electrolyte inlet means and the electrolyte-soluble ion and gaseous electrolysis products outlet means, each said bipolar metal electrode comprising:

a generally-rectangular, plate-like metallic cathode, a generally-rectangular, plate-like metallic anode, said plate-like metallic cathode and anode being disposed in edge-to-edge butting relationship, thereby to align said plate-like metallic cathode to lie in the same plane as said plate-like metallic anode; and said butting relationship between said plate-like metallic anode and said plate-like metallic cathode being provided by a coextensive joint between said respective abutting edges of said plate-like metallic anode and said plate-like metallic cathode, said joint comprising a mechanical integration fit between a plurality of male tongues on an edge of one metallic plate and a similar plurality of female grooves in an edge of the other metallic plate;

around said joint, an electrically-non-conductive material disposed between said anode plate and said cathode plate for lowering electrical current leakage;

one end wall providing an anodic terminal connection, with an anode bus bar connected to said anode terminal connection; and the other end wall providing a cathodic terminal connection with a cathodic bus bar connected to said cathodic terminal connection.

* * * * *

UNITED STATES PATENT AND TRADEMARK OFFICE

CERTIFICATE OF CORRECTION

PATENT NO. : 5,225,061

DATED : July 6, 1993

INVENTOR(S) : Westerlund

It is certified that error appears in the above-indentified patent and that said Letters Patent is hereby corrected as shown below:

In the Abstract, line 13, after "between"
delete "a plurality"
Column 1, line 6, change "it" to --It--
Column 2, line 56, change "no." to --No.--
Column 3, line 6, change "patent" to --Patent--
Column 3, line 8, change "plate" to --plates--
Column 3, line 35, change "NO." to --No.--
Column 3, line 55, change "canadian" to --Canadian--
Column 4, line 6, change "the" to --The--
Column 7, line 33, change "thickness" to --thicknesses--
Column 7, line 36, change "node" to --anode--
Column 10, line 7, after "certain" insert --amount--
Column 13, line 11, change "electrodes" to --electrode--

Signed and Sealed this

Fifth Day of April, 1994

Bruce Lehman

*Attest:*

BRUCE LEHMAN

*Attesting Officer*

*Commissioner of Patents and Trademarks*